United States Patent [19]

Fiedler et al.

[11] 4,047,460

[45] Sept. 13, 1977

[54] DRUMSTICK

[75] Inventors: Mark A. Fiedler; Darrell M. Hart, both of Edina, Minn.

[73] Assignee: Riff Rite, Inc., Edina, Minn.

[21] Appl. No.: 697,705

[22] Filed: June 21, 1976

Related U.S. Application Data

[63] Continuation-in-part of Ser. No. 632,607, Nov. 17, 1975, abandoned.

[51] Int. Cl.[2] ..... G10D 13/00

[52] U.S. Cl. ..... 84/422 S

[58] Field of Search ..... 84/422, 422 S, 452, 84/452 P

[56] References Cited

U.S. PATENT DOCUMENTS

| | | | |
|---|---|---|---|
| 3,147,660 | 9/1964 | Brilhart | 84/422 S |
| 3,489,052 | 1/1970 | Colyer et al. | 84/422 S |
| 3,608,419 | 9/1971 | Russell | 84/422 S |
| 3,958,485 | 5/1976 | Peters | 84/422 S |

*Primary Examiner*—Lawrence R. Franklin
*Attorney, Agent, or Firm*—Stuart R. Peterson

[57] ABSTRACT

Two parts or shells, each composed of randomly oriented carbon or graphite fibers contained in a nylon matrix, are configured so that when sonically welded together an integral drumstick results.

6 Claims, 6 Drawing Figures

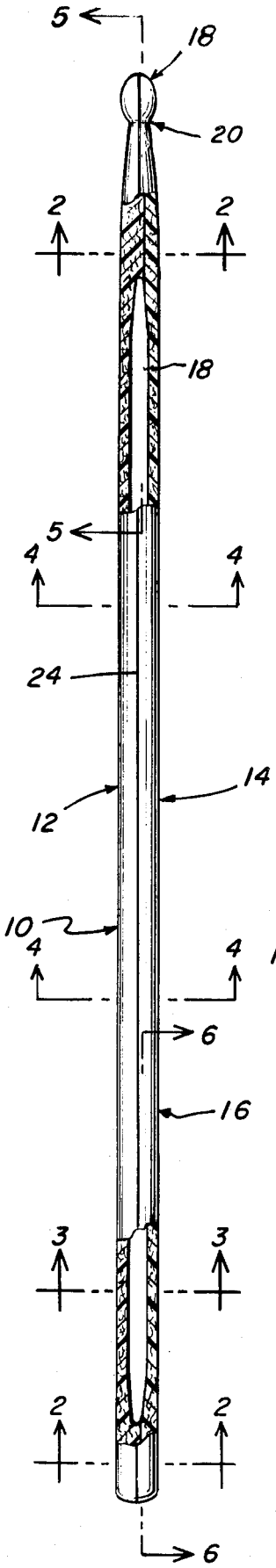
FIG. 2
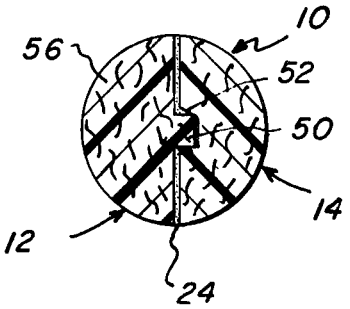
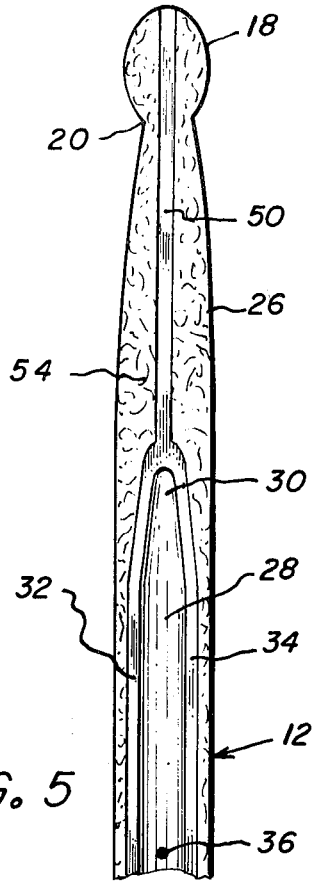
FIG. 5
FIG. 3
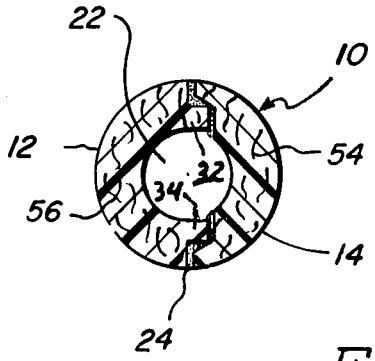
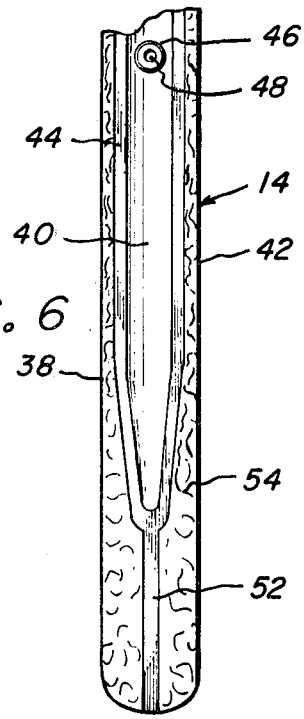
FIG. 6
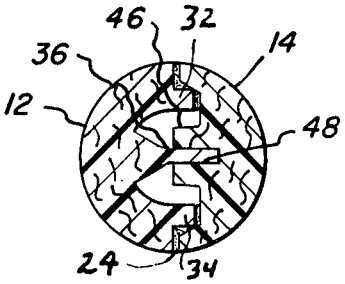
FIG. 4

DRUMSTICK

CROSS-REFERENCE TO RELATED APPLICATION

This is a continuation-in-part of our abandoned application, Ser. No. 632,607, filed Nov. 17, 1975.

BACKGROUND OF THE INVENTION

1. Field of the Invention

This invention relates generally to drumsticks, and pertains more particularly to a drumstick containing carbon or graphite fibers.

2. Description of the Prior Art

Even though various compositions have been resorted to in efforts to provide drumsticks having improved characteristics, wood still is the most commonly used material. In this regard, in spite of the fact that wooden drumsticks are vulnerable to warpage and splintering, drummers continue to prefer the feel of such sticks and also like the tonal qualities that they produce.

Attempts have been made to make various composite drumsticks, using metal and/or plastics. While warpage and splintering can be reduced, or even eliminated, the feel and tonal qualities are not comparable to the wooden drumsticks.

Therefore, many drummers are willing to put up with the inadequacies of wooden drumsticks because, in their opinion, the benefits outweigh the shortcomings, and this accounts, at least in our opinion, for the continued use of wooden drumsticks in spite of the foregoing inadequacies.

SUMMARY OF THE INVENTION

Accordingly, a general object of the present invention is to provide a drumstick that will, for all intents and purposes, possess the favorable attributes of wooden drumsticks, even being superior in certain respects, and which will not retain the drawbacks of wooden sticks.

More specifically, an object of the invention is to provide a drumstick that will be long-lasting in that it possesses an appreciably greater strength than wooden sticks, being for all intents and purposes immune to breakage under even the most severe impact forces. In addition to being virtually break-proof, an aim of the invention is to provide a drumstick that will not splinter, as wooden drumsticks are prone to do.

Another object is to provide a drumstick that will be lighter in weight, as well as stronger, than wooden drumsticks. In this regard, not only are lightweight materials contemplated, but the invention permits the employment of a hollow bore which extends throughout a major portion of the drumstick's length.

A further object is to provide a drumstick that can be very simply and inexpensively fabricated. In this regard, it is planned that the drumstick be molded in two parts or shells which are longitudinally secured together. More specifically, it is an aim of the invention to injection mold each shell so that the two can be secured together by means of sonic welding.

Additionally, an object is to provide a drumstick that will not only be lighter in weight, thereby reducing the likelihood of drummer fatigue, but which will enable the user to perform better in that he can increase the number of riffs or rolls per unit of time, this being particularly advantageous when performing a drum solo.

Still one addtional object is to provide a drumstick that will not warp or become distorted when exposed to various temperatures and changes in humidity.

Briefly, our invention envisages a drumstick containing randomly oriented carbon or graphite fibers dispersed in a nylon plastic matrix. In this regard, it is planned that on a volume basis that the carbon or graphite fibers constitute approximately 30% and the nylon matrix the remainder of the material, more specifically approximately 70% of the total volume of the drumstick material. A feature of the invention resides in the making of the drumstick in two parts or shells, each having a configuration such that they can be readily fitted together and sonically welded.

BRIEF DESCRIPTION OF THE DRAWINGS

FIG. 1 is a side elevational view of our drumstick, portions thereof being in section in order to show to better advantage the internal construction of the stick;

FIG. 2 is an enlarged sectional view taken in the direction of line 2—2 at two longitudinally spaced locations of FIG. 1 for the purpose of depicting the tongue and groove relation employed in the opposite end regions of the drumstick;

FIG. 3 is an enlarged sectional view taken in the direction of line 3—3 of FIG. 1 for the purpose of showing the hollow bore cross section that extends throughout the major portion of the drumstick handle;

FIG. 4 is an enlarged sectional view taken in the direction of line 4—4 at the two longitudinally spaced locations where the bore configuration differs from that appearing in FIG. 3;

FIG. 5 is a slightly enlarged fragmentary view taken in the direction of line 5—5 of FIG. 1, the view being taken in the direction of one mating surface of the part or shell at the left in FIG. 1, and FIG. 6 is a fragmentary view on the same scale as FIG. 5 but with the view being taken in the direction of the mating surface of the other part or shell at the right in FIG. 1.

DESCRIPTION OF THE PREFERRED EMBODIMENT

Referring now in detail to the drawing, the exterior of our drumstick 10 is the same as a wooden drumstick. Actually, it is comprised of two parts or shells 12 and 14 which can be fitted or mated with each other and sonically welded together as will be described with greater particularity hereinafter. Since the drumstick 10 is of conventional shape when the shells 12, 14 are assembled, it includes a handle 16, a striking tip 18 and a connecting neck 20.

The drumstick 10 has a generally hollow bore 22 (FIG. 3) which extends throughout a substantial portion of the length of the drumstick handle 16; however, it will be seen from FIG. 1 that the bore 22 terminates within the handle 16 in a spaced relation with respect to the neck 20 and the free end (the lower end as the drumstick is oriented in FIG. 1) of the handle 16. Although not discernible in the finished drumstick, a mating line 24 appears in FIG. 1, this line being where the faces of the two parts or shells 12, 14 are joined together, it being contemplated, as already mentioned, that sonic welding be employed.

Describing the part or shell 12 in detail, it will be noted that it is formed with a generally flat surface 26 (see FIG. 5) and a longitudinal groove 28 having converging ends, the converging end appearing in FIG. 5 having been given the reference numeral 30. As can best be seen from FIGS. 3 and 4, although also visible in FIG. 5, ribs 32 and 34 extend along each side of the groove 28. Still further, at the two spaced locations indicated by the directional lines 4—4 in FIG. 1, are pins 36 which project beyond the plane of the ribs 32 and 34. One of these pins 36 appears in FIG. 5 as well as being represented in the sectional view constituting FIG. 4.

As far as the part or shell 14 is concerned, it is intended to mate with the shell 12. More specifically, it has a generally flat surface 38 which confronts the surface 26 of the shell 12 to form the mating line 24. Coacting with the groove 28 in forming the hollow bore 22 is a groove 40. In order to accommodate the ribs 32, 34 the groove 40 has a recess 42 extending along one side for receiving the rib 32 and a recess 44 extending along its other side for receiving the rib 34. Additionally, there are two bosses 46 in alignment with the pins 36, each boss 46 containing a hole 48 into which a pin 36 extends. In this way, the pins 36 assure a precise and easy mating together of the parts or shells 12, 14.

Also assisting in maintaining the parts or shells 12, 14 in a mated relation are tongues 50 on the surface 26 of the shell 12, one tongue extending from the upper end 30 (at the juncture of the ribs 32, 34) of the groove 28 to the extreme end of the striking tip 18, as is believed evident from the upper directional line 2—2 of FIG. 1 producing FIG. 2 and as can be clearly seen in FIG. 5, and the other tongue extending from the other end of the groove 28 to the lower or free end of the handle 16, as is believed evident from the lower directional line 2—2 of FIG. 1 also producing FIG. 2. The two tongues 50 are received in grooves 52 correspondingly formed in the surface 38. Thus, one groove 52 extends from the upper end of the longitudinal groove 40 to the extreme upper end of the striking tip 18, and the other groove 52, as can be seen in FIG. 6, extends from the lower end of the groove 40 (where the recesses 42, 44 come together) to the lower end or bottom of the handle 16. The grooves 52 each have one sloping side wall (approximately 30° as will the perceived in FIG. 2 where the lead line for reference numeral 52 terminates) so that the tongues 50, which have parallel side walls, can be readily received therein.

With the parts or shells 12, 14 configured as described above, the shells can be placed together in preparation for their permanent attachment through the agency of sonic welding. More specifically, the pins 36 on the shell 12 fit into the holes 48 of the bosses 46 on the shell 14. The tongues 50 and supplemental grooves 52 also contribute to a precise registration of the shells 12, 14 so that a smooth and continuous outer surface on the drumstick 10 results, the mating or weld line 24 (exaggeratively depicted in FIGS. 2–4) disappearing in the final drumstick. Whereas the assembled and finished drumstick 10 has been pictured in FIG. 1, it will be appreciated that the line 24 has been shown mainly to denote the initially separate and distinct parts or shells 12 and 14.

The composition of the drumstick 10 is exceedingly important. In this regard, the material constituting the drumstick 10 contains graphite or carbon fibers which have been given the reference numeral 54 and which are randomly oriented in a matrix 56 of nylon. More specifically, the graphite or carbon fibers 54 constitute approximately 30 percent of the volume of the material of which the drumstick 10 is composed, and the matrix 56 the remainder, that is approximately 70 percent. However, the composition is susceptible to some variation and it is planned that the graphite or carbon fibers fall within the range of from 25–35 percent of the volume of the material and that the nylon matrix 56, which constitutes the remainder, fall within the range of from 65–75 percent.

It has already been pointed out that the drumstick 10 is comprised of two parts or shells 12 and 14. Having described the configuration and having given the composition of the drumstick 10, it will now be appreciated that the two parts or shells 12, 14 lend themselves readily to being fabricated by injection molding. Once joined by sonic welding, the drumstick 10 is the same as a one-piece drumstick having the core or bore 22, a construction not otherwise achievable.

Once assembled and welded, the drumstick 10 becomes virtually indestructible and will, unless severely abused, last indefinitely. The lighter weight, immunity to warpage and excellent tone-producing qualities of our drumstick 10, these being in addition to its increased strength, make it an exceedingly attractive instrument.

We claim:

1. A drumstick comprising an elongated handle, a rounded striking tip and a reduced diameter neck connecting said tip to said handle characterized in that the drumstick includes two elongated parts secured together to form said tip, neck and handle, each part having a longitudinal groove therein so that a longitudinal bore is provided within said handle, the material forming said tip, neck and at least the portion of said handle adjacent said neck containing graphite fibers.

2. A drumstick as characterized in claim 1 in which said bore terminates within said handle, one end of said bore being spaced from said neck and the other end thereof from the free end of said handle.

3. A drumstick as characterized in claim 2 in which one of said elongated parts has a first tongue extending from said one end of its groove to the free end of said tip and a second tongue extending from said other end of its groove to the free end of said handle, the other of said elongated parts having grooves for receiving said tongues therein.

4. A drumstick as characterized in claim 3 in which said one elongated part has a rib extending along each side of its elongated groove and said other part is recessed along each side of its elongated groove so as to receive said ribs therein.

5. A drumstick as characterized in claim 4 in which said one elongated part has a pair of longitudinal spaced pins projecting from the base of its longitudinal groove between said ribs to a location beyond said ribs, and said other part has a pair of bosses projecting from the base of its groove in general alignment with said pins, said bosses having recesses therein for receiving the projecting ends of said pins.

6. A drumstick as characterized in claim 5 in which the material forming said tip, neck and handle also contains nylon, the nylon serving as a matrix for said graphite fibers.

* * * * *